US007623671B2

(12) United States Patent
Akino

(10) Patent No.: US 7,623,671 B2
(45) Date of Patent: Nov. 24, 2009

(54) NARROW DIRECTIONAL MICROPHONE

(75) Inventor: Hiroshi Akino, Machida (JP)

(73) Assignee: Kabushiki Kaisha Audio-Technica, Machida-shi (JP)

( * ) Notice: Subject to any disclaimer, the term of this patent is extended or adjusted under 35 U.S.C. 154(b) by 800 days.

(21) Appl. No.: 11/226,198

(22) Filed: Sep. 15, 2005

(65) Prior Publication Data

US 2006/0078145 A1 Apr. 13, 2006

(30) Foreign Application Priority Data

Oct. 8, 2004 (JP) ..... 2004-295674

(51) Int. Cl.
*H04R 9/08* (2006.01)

(52) U.S. Cl. ..... 381/356; 381/358; 381/359

(58) Field of Classification Search ..... 381/355, 381/356, 357, 358, 359, 360
See application file for complete search history.

(56) References Cited

U.S. PATENT DOCUMENTS 4,347,844 A * 9/1982 Ohki et al. ..... 604/368
6,418,229 B1 * 7/2002 Staat ..... 381/357
7,251,340 B2 * 7/2007 Juhler ..... 381/361

FOREIGN PATENT DOCUMENTS

| | | |
|---|---|---|
| JP | 62-118697 | 5/1987 |
| JP | 62-118698 | 5/1987 |
| JP | 11-331978 | 11/1999 |
| JP | 2000-83292 | 3/2000 |

OTHER PUBLICATIONS

U.S. Appl. No. 11/416,201, filed May 3, 2006, Akino.

* cited by examiner

*Primary Examiner*—Brian Ensey
(74) *Attorney, Agent, or Firm*—Oblon, Spivak, McClelland, Maier & Neustadt, L.L.P.

(57) ABSTRACT

A narrow directional microphone includes an acoustic tube made of a resin film having thousands of minute holes, and a microphone unit attached in a rear end of the acoustic tube. The acoustic tube is made of a resin film having thousands of minute holes and curled up. The minute holes let air in but block droplets.

12 Claims, 5 Drawing Sheets

NARROW DIRECTIONAL MICROPHONE

CROSS REFERENCE TO RELATED APPLICATIONS

This application is based upon and claims the benefit of priority from prior Japanese Patent Application No. 2004-295,674 filed on or around Oct. 8, 2004; the entire contents of which are incorporated by reference herein.

BACKGROUND OF THE INVENTION

1. Field of the Invention

This invention relates to a narrow directional microphone comprising an acoustic tube, and more particularly relates to a narrow directional microphone of which directivity is not lowered even if water droplets sticks onto the acoustic tube.

2. Description of the Related Art

Usually, a narrow directional microphone comprises a long thin acoustic tube. A microphone unit is attached in a rear end of the acoustic tube, detects acoustic waves arriving via a front end of the acoustic tube, and converts the acoustic waves into audio signals.

With an example of the narrow directional microphones of the related art, an acoustic tube has slits on an inner peripheral surface thereof. The slits are covered by an acoustic resistor made of a thin synthetic resin film or non-woven fabric. Such a narrow directional microphone makes acoustic waves arriving via the front end thereof interfere with acoustic waves arriving from the peripheral surface via the acoustic resistor and the slits, thereby assuring the directionality.

The directionality of such a narrow directional microphone varies with a changing acoustic resistance of the acoustic resistor extending over the slits on the acoustic tube. For instance, when the narrow directional microphone is used outdoors, raindrops may stick onto and moisten the acoustic resistor. In such a case, the acoustic resistance will be increased, acoustic waves do not pass through the acoustic resistor, and the directivity of the microphone will be lowered.

The assignee of this application has already proposed a narrow directional microphone in which slits on the acoustic tube are covered by a thin synthetic resin film or non-woven fabric in order to improve the directivity. Refer to Japanese Laid-Open Patent Publication No. Sho 62-118,697 (called the "Reference 1.). However, when an acoustic resistor is moistened, the acoustic resistance will be increased or acoustic waves do not pass, which means that the directivity of the microphone will be lowered.

One example of existing narrow directional microphones will be described hereinafter. Referring to FIG. 4(A) to FIG. 4(C) and FIG. 5(A) to FIG. 5(C) of the accompanying drawings, a narrow directional microphone 10 includes an acoustic tube 20, slits 22, an acoustic resistor 24, a microphone unit 30, and a cylindrical grip 40. The acoustic tube 20 is a thin long cylinder made of metal, and has the slits 22 extending along the center axis thereof and on an inner peripheral surface thereof. The slits 22 are arranged at equal intervals. The acoustic resistor 24 extends over the inner surface of the acoustic tube 20 and the slits 22. The acoustic tube 20 has open ends. In those figures, each left end of the acoustic tube 20 is a front end while each right end thereof is rear end. The microphone unit 30 is provided in the rear end of the acoustic tube 20. The cylindrical grip 40 is coupled to the rear end of the acoustic tube 20.

Acoustic waves arriving via the front end of the acoustic tube 20 and those arriving via the slits 22 and the acoustic resistor 24 are made to interfere with one another, which promotes the narrow directivity. Refer to FIG. 4(A) to FIG. 4(C) and FIG. 5(A) and FIG. 5(C).

Further, the narrow directional microphone using the acoustic tube suffers from noises caused by winds. The rear end of the acoustic tube is connected to a front acoustic terminal of the microphone unit. When the acoustic tube is coupled to the microphone unit, a distance is extensively increased between the front and rear acoustic terminals, which would result in noises caused by winds. The assignee of this application has also proposed a narrow directional microphone which includes a microphone unit and measures against noises caused by winds. Refer to Japanese Patent Laid-Open Publication No. Hei 11-331,978 (called the "Reference 2"). In the Reference 2, a clearance is provided between an outer peripheral surface of a microphone unit and an inner peripheral surface of an acoustic tube, and front and rear acoustic terminals of the microphone unit are short-circuited by acoustic impedance in the foregoing clearance. Acoustic waves having very low frequencies such as noise caused by winds can be short-circuited by the acoustic impedance, which is effective in reducing noise caused by winds.

Noises caused by vibrations in the narrow directional microphone depend upon mass of air in the acoustic tube. Therefore, the longer the acoustic tube, the more the mass of air in the acoustic tube and the more noises caused by vibrations. The invention in the Reference 2 can also reduce the noises caused by vibrations since the front and rear acoustic terminals of the microphone units are acoustically short-circuited.

As described above, the Reference 2 is effective in reducing noises caused by winds and vibrations. The narrow directional characteristics of the Reference 2 are improved by making acoustic waves arriving via the front end of the acoustic tube and the slits on the peripheral surface of the acoustic tube interfere with acoustic waves arriving via the slits and the acoustic resistor. Therefore, if the acoustic resistor is moistened by raindrops, the directivity of the microphone will be damaged. In other words, the microphone is protected against noises, but no measures are taken in order to prevent the directivity from being lowered by moisture.

SUMMARY OF THE INVENTION

A narrow directional microphone includes an acoustic tube made of a resin film having thousands of minute holes, and a microphone unit attached in a rear end of the acoustic tube. The acoustic tube is made of a resin film having thousands of minute holes and curled up. The minute holes let air in but block droplets.

DESCRIPTION OF THE INVENTION

Figure 1:
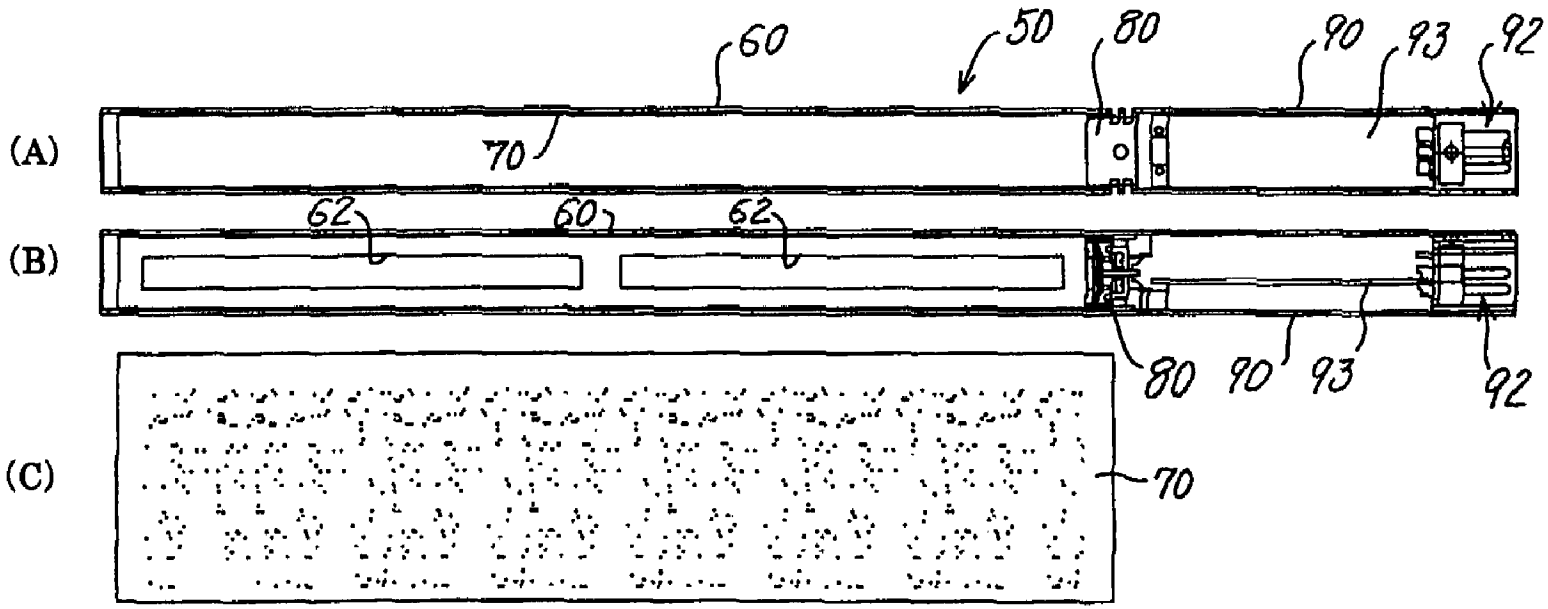
FIG. 1(A) is a front and sectional view of a narrow directional microphone according to the invention.
FIG. 1(B) is a top and sectional view of the narrow directional microphone.
FIG. 1(C) is a front elevation of a resin film constituting an acoustic tube.

The invention will be described with reference to one embodiment shown in the drawings.

Figure 2:
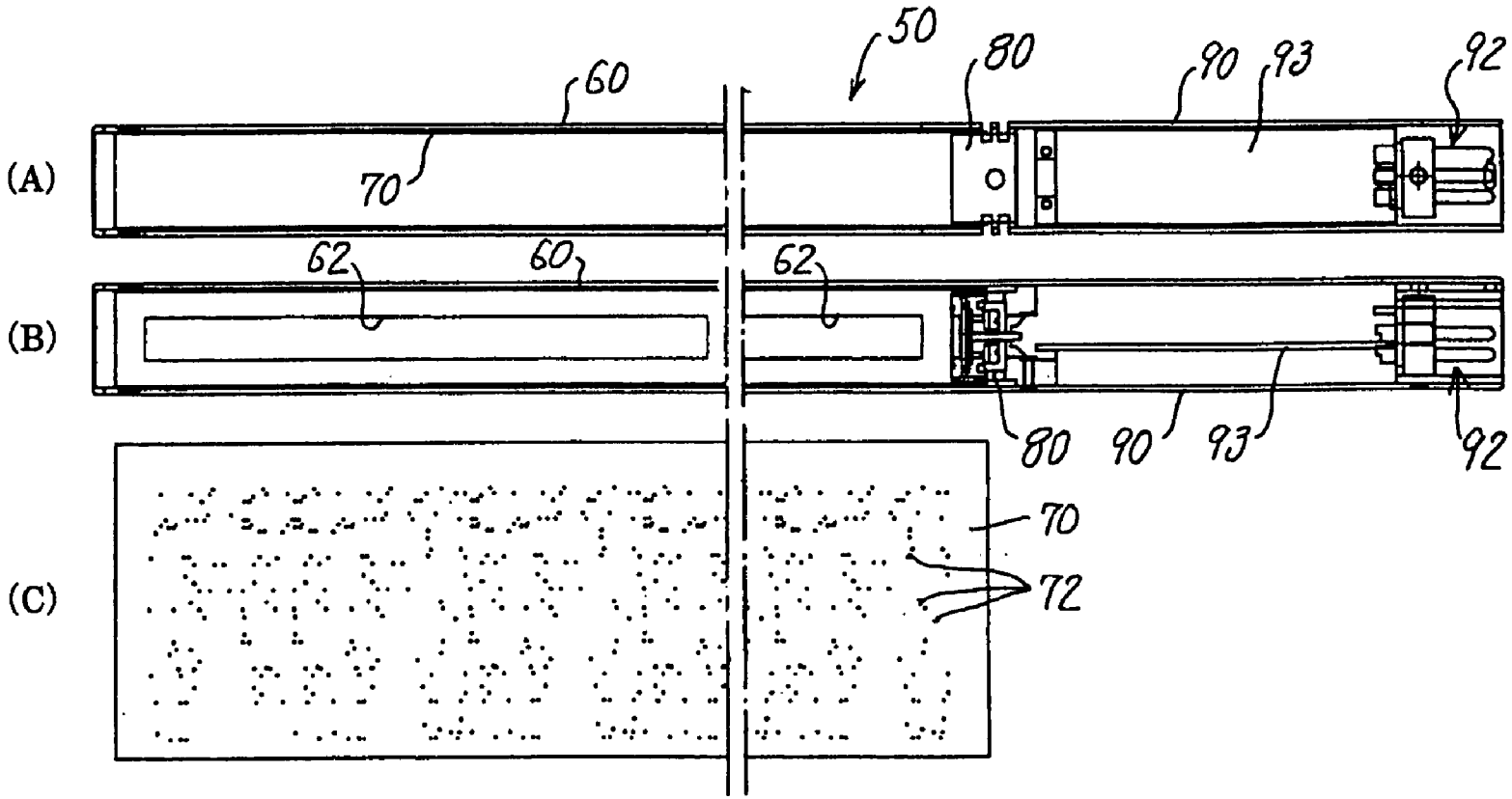
FIG. 2(A) to FIG. 2(C) are views similar to FIG. 1(A) to FIG. 1(C), but on an enlarged scale, but partly omitted.

Referring to FIG. 1(A) to FIG. 1(C) and FIG. 2(A) to FIG. 2(C), a narrow directional microphone 50 comprises a microphone housing 60, an acoustic tube 70, a microphone unit 80, and a grip 90. The acoustic tube 70 is made of a thin and rectangular resin film, which is curled up to be a long cylinder as shown in FIG. 1(A) and FIG. 2(A). The resin film has numerous minute holes 72 which are arranged at equal intervals. In short, the acoustic tube 70 has its inner peripheral surface covered by the resin film.

The resin film is a 50 μm-thick fluoric resin film, which has 2 or 3 holes per centimeter. The holes 72 have a diameter of 0.2 mm to 0.4 mm. In short, the acoustic tube 70 has an inner diameter of 18 mm, and length of 27 cm.

The acoustic tube 70 is open at its opposite ends. In FIG. 1(A) to FIG. 1(C) and FIG. 2(A) to FIG. 2(C), the left end is called the "front end" while the right end is called the "rear end". The microphone unit 80 is positioned in the rear end of the acoustic tube 70. The acoustic tube 70 is made of the resin sheet curled up in the cylindrical shape, and is mechanically weak, so that it is housed in the microphone housing 60. In short, the microphone housing 60 made of metal or plastics reinforces the acoustic tube 70. The acoustic tube 70 loosens in the microphone housing 60, and is in close contact with the inner surface thereof. Thin and long windows 62 are formed in parallel to the axis line of the microphone housing 60, and are much larger than the open ends of the acoustic tube 20 of the related art shown in FIG. 4(A) to FIG. 4(C) and FIG. 5(A) to FIG. 5(C). The windows 62 occupy a large part of the periphery of the microphone housing 60. The acoustic tube 60 functions as a main part of the narrow directional microphone while the microphone housing 60 simply protects or reinforces the acoustic tube 70. The minute holes 72 on the acoustic tube 70 function as an acoustic resistor. Therefore, the microphone housing 60 is preferably as large as possible so long as it reliably reinforces the acoustic tube 70.

The microphone unit 80 has its outer peripheral surface supported by the microphone housing 60 via the acoustic tube 70. As stated in the Reference 2, the clearance may be made between the outer surface of the microphone unit 80 and the inner surface of the acoustic tube 70, and front and rear acoustic terminals of the microphone unit 80 may be acoustically short-circuited by acoustic impedance offered by the foregoing clearance. This is effective in reducing noise caused by winds.

The cylindrical grip 90 is coupled to the rear end of the microphone housing 60, and includes at its rear end a connector 92 which transmits electric signals outward. Acoustic signals are converted into the electric signals by the microphone unit 80. Further, the grip 90 houses a circuit board 93, which connects the connector 92 and the microphone unit 80, and establishes an electric circuit if necessary.

The foregoing embodiment is advantageous in the following respects.

(1) The acoustic tube 70 having thousands of minute holes is prevented from resonating in response to acoustic waves.

(2) The acoustic tube 70 serves as an acoustic capacitor and as acoustic mass for acoustic waves coming indirectly, and the minute holes on the acoustic tube 70 serves as the acoustic resistor for acoustic waves coming via the front end thereof. Therefore, the acoustic waves arriving via the front end and those arriving via the minute holes interfere with one another, thereby realizing the narrow directional microphone.

(3) The film constituting the acoustic tube 70 and having numerous minute holes 72 can prevent entry of raindrops into the acoustic tube 70, which is effective in protecting the directionality of the microphone.

(4) The acoustic tube 70 constituted by the curled up film is effective in reducing the number of components and a manufacturing cost of the microphone.

Figure 3:
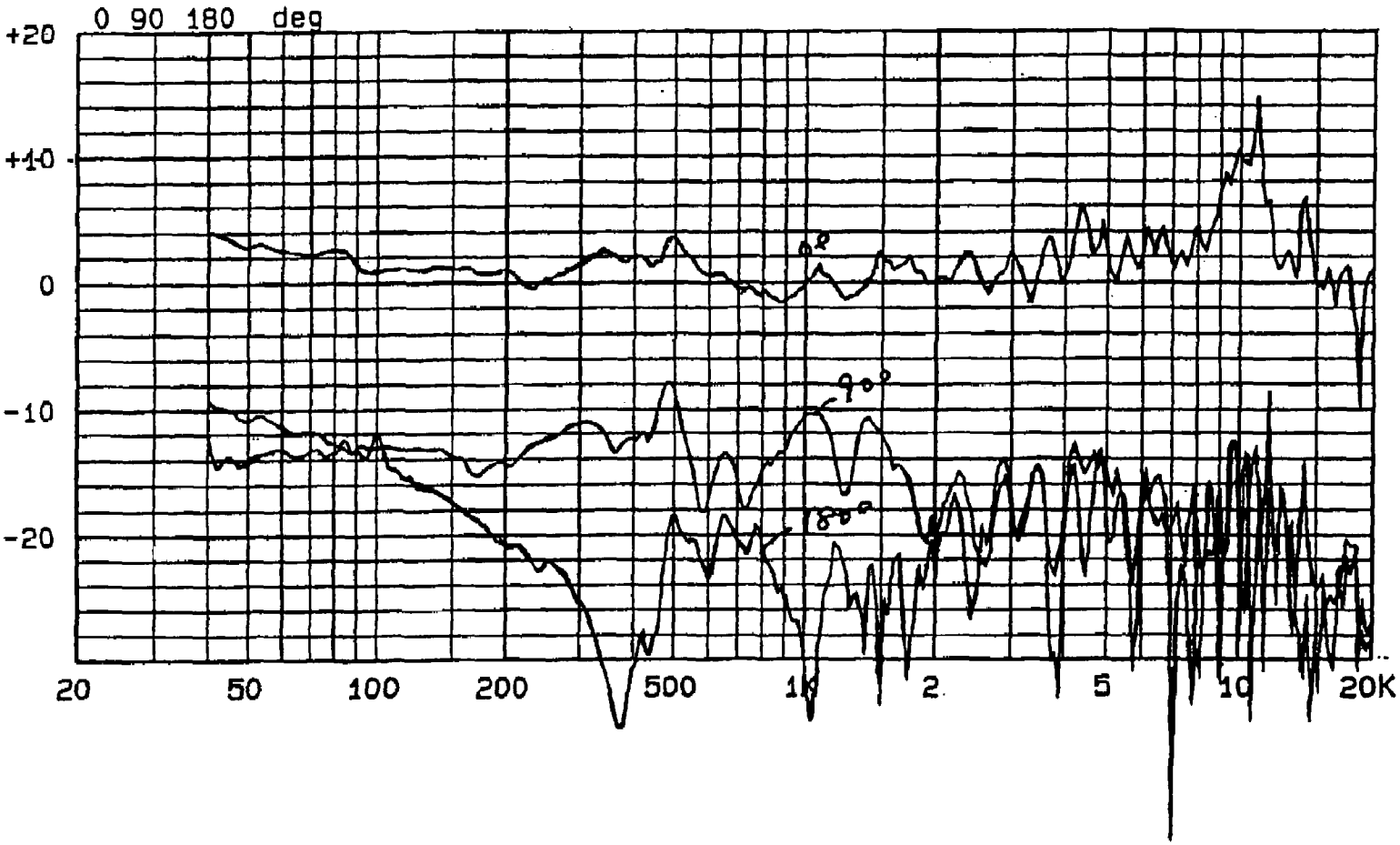
FIG. 3 is a graph showing directional frequency response of the microphone according to the invention.
Figure 4:
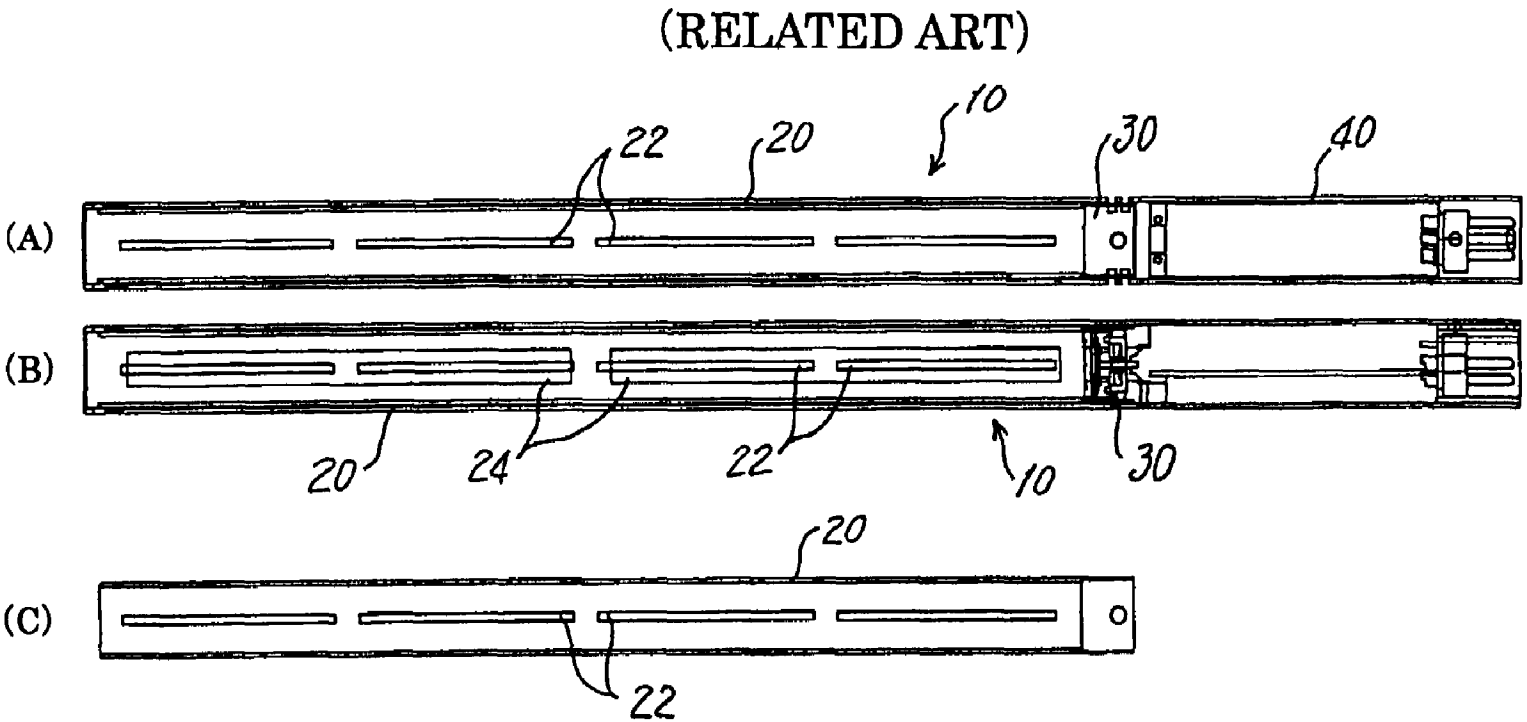
FIG. 4(A) is a front and sectional view of a narrow directional microphone of the related art.
FIG. 4(B) is a top and sectional view of the narrow directional microphone of the related art.
FIG. 4(C) is a front and sectional view of an acoustic tube.
Figure 5:
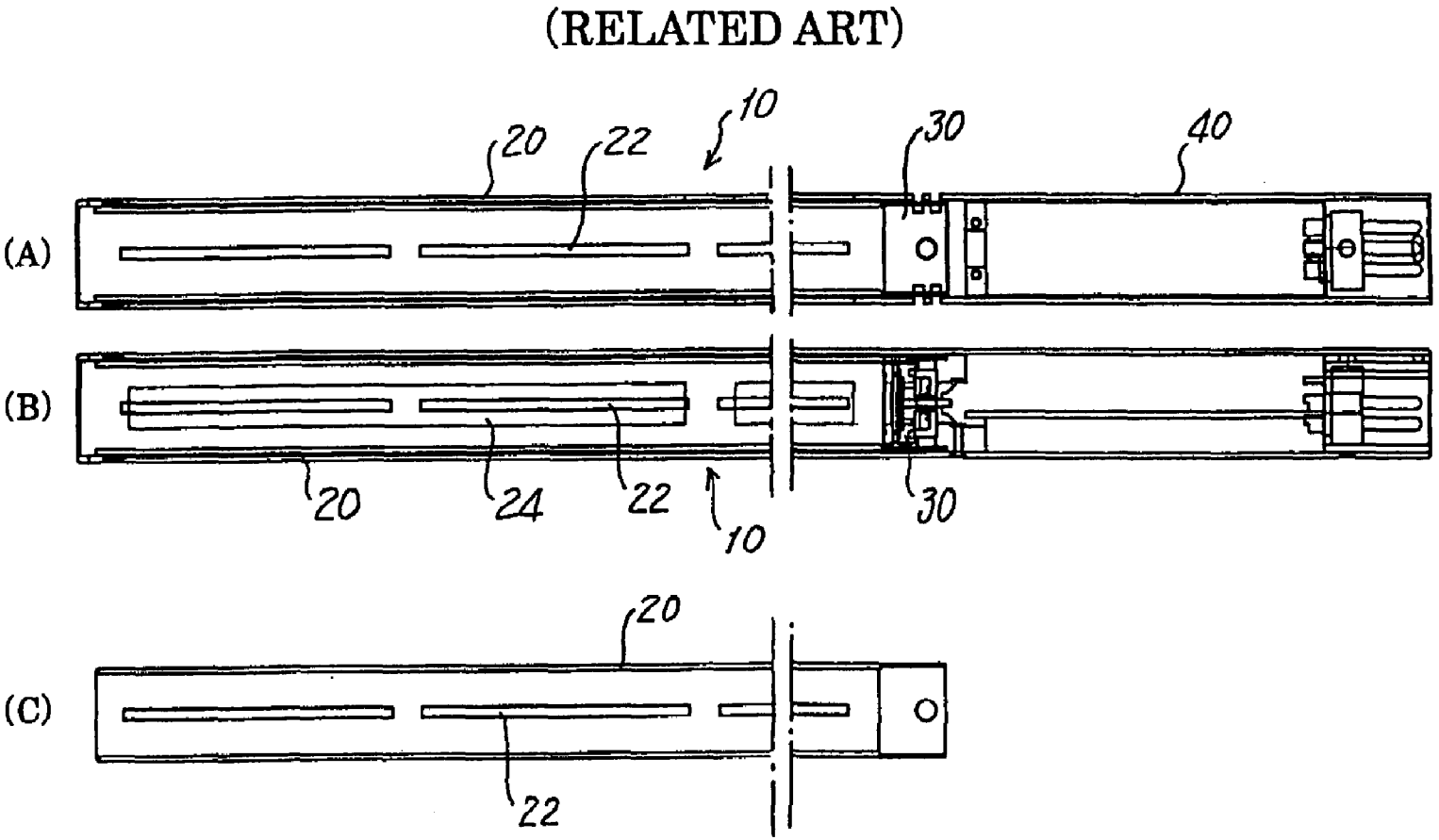
FIG. 5(A) to FIG. 5(C) are views similar to FIG. 4(A) to FIG. 4(C), but on an enlarged scale, but partly omitted.

The narrow directional microphone has a directional frequency response as shown in FIG. 3, in which the abscissa denotes frequencies while the ordinate denotes levels of converted signals. Sounds are measured at 0 degree, 90 degrees and 180 degrees with respect to the center axis of the acoustic tube 70. Specifically, the sounds arrive via the front end, via the side, and via the rear end of the acoustic tube 70, respectively. As can be seen from FIG. 3, the level of the signal at 0 degree is clearly higher than those of the signals at 90 degrees and 180 degrees, and the signal levels are substantially flat throughout the frequency ranges, which means that the narrow directional microphone has a good frequency response.

The narrow directional microphone of the invention is applicable not only to professional use but also to consumer use. For instance, it is usable as a microphone attached to a recording device or video recorder or as an accessory.

What is claimed is:

1. A narrow directional microphone comprising:

an acoustic tube made of a resin film having thousands of minute holes which let air in but block raindrops, and a microphone unit attached in a rear end of the acoustic tube.

2. The microphone of claim 1, wherein the resin film is curled to make the acoustic tube cylindrical.

3. The microphone of claim 2, wherein the acoustic tube is housed in a microphone housing and is in close contact with an inner surface of the microphone housing.

4. The microphone of claim 3, wherein the microphone housing has windows on a surface thereof.

5. The microphone of claim 1, wherein the film constituting the acoustic tube is made of a fluorocarbon resin.

6. The microphone of claim 3, wherein the microphone housing includes a grip at a rear end thereof.

7. The microphone of claim 1, wherein the acoustic tube does not resonate in response to acoustic waves.

8. The microphone of claim 1, wherein the resin film is a 50 μm-thick fluoric resin film.

9. The microphone of claim 1, wherein the resin film has 2 or 3 holes per centimeter.

10. The microphone of claim 1, wherein the minute holes have a diameter of 0.2 to 0.4 mm.

11. The microphone of claim 1, wherein the acoustic tube serves as an acoustic capacitor and as an acoustic mass for acoustic waves entering indirectly.

12. The microphone of claim 1, wherein the minute holes serve as an acoustic resistor for acoustic waves entering via a front end of the minute holes.

* * * * *